United States Patent [19]

Wade

[11] 4,045,019

[45] Aug. 30, 1977

[54] COMBINATION ANIMAL TOY AND CONTAINER

[76] Inventor: Robert J. Wade, 104 Crestline Drive, Charleston Heights, S.C. 29405

[21] Appl. No.: 645,822

[22] Filed: Dec. 31, 1975

[51] Int. Cl.[2] ..... A63G 31/00

[52] U.S. Cl. ..... 272/1 A; 254/144

[58] Field of Search ..... 272/1 R, 1 B, 2, 3; D34/5 F, 2 R, 2 C; 254/144; 187/11

[56] References Cited

U.S. PATENT DOCUMENTS

| | | | |
|---|---|---|---|
| 331,608 | 12/1885 | Bishop | 254/144 X |
| 1,572,630 | 2/1926 | Whiteside | 272/1 A |
| 1,744,079 | 1/1930 | Phillips | 272/1 A |
| 1,748,932 | 2/1930 | Medart et al. | 272/1 A |
| 2,673,086 | 3/1954 | Brown, Sr. | 272/1 A |
| 2,724,123 | 11/1955 | Kesler | 272/1 A UX |
| 3,823,426 | 7/1974 | Mitchko | 272/1 A UX |
| D. 130,746 | 12/1941 | Oermann | D34/5 F |

*Primary Examiner*—Richard C. Pinkham
*Assistant Examiner*—Arnold W. Kramer
*Attorney, Agent, or Firm*—Larry Harold Kline

[57] ABSTRACT

A container which may be used as a sandbox, swimming pool, or play area simulates an animal configuration. The lower portion of the container, supported on simulated animal legs, is surrounded by an oval shaped rim for sitting on. A cover in the form of a simulated animal's back is guided for vertical movement by vertical supports and raised or lowered by a crankbar connected thereto by a plurality of lines to give access to the interior of the container. Simulated animal appendages such as heads, tails, etc. can extend from the container. One version is a simulated turtle.

4 Claims, 4 Drawing Figures

COMBINATION ANIMAL TOY AND CONTAINER

This invention relates to a container for use by children and more particularly to a combination animal toy and container, which can be used in varying ways for different purposes.

Children enjoy animal toys. Sandboxes, swimming pools, and playing areas are also enjoyable to children. The present invention combines a container which may be used as a sandbox, swimming pool, or play area with an animal toy, and creates new and useful pleasure for children of all ages.

An object of this invention is to combine an animal toy and a container.

A further object of this invention is to provide an animal toy and container, which will have the capability of keeping the materials in the container covered.

Still another object of this invention is to provide a simple means to hold a cover, for a combination animal toy and container, at varying distances above the container.

Another object of this invention is to provide a combination animal toy and container with a basic concept that could apply to many different animals.

Another object of this invention is to provide a combination animal toy and container with a container that can be used as a sandbox, swimming pool or simply a play area.

These and other objects and featuers of the invention will be apparent from the following description and appended claims.

Briefly, the invention is a combination animal toy and container comprising container means and cover means. The container means is operative to hold materials and shaped so that a child may enter. The cover means is operative to cover the container means and is shaped to simulate the outer portion of an animal. The invention may further comprise appendage means simulating a plurality of appendages of an animal. The appendage means may comprise a plurality of bottom supports which simulate the feet of an animal. The appendage means may further comprise a simulated head of an animal. Elevating means are connected to the container means and cover means and operate to raise or lower the cover means over the container means. A rim, of sufficient width so that a child may sit thereon, may surround the container means. Drain means may be provided in the bottom of the container means. The simulated animal may be a turtle with a simulated turtle head, turtle feet and turtle shell. The container means may be used as a sandbox, a swimming pool, or simply a play area. The elevating means may comprise a plurality of vertical supports, a crankbar, a crank and a plurality of line. The vertical supports connect to the container means and extends through the cover means. The crankbar extends through the upper portion of the plurality of vertical supports. The plurality of line is secured to the cover means and the crankbar. When the crank is turned, the crankbar revolves to wrap the plurality of line around the crankbar and, therefore, to raise or lower the cover means. Cover means support guides may be contained within the cover means, whereby each of the plurality of vertical supports extends through the plurality of cover means support guides. An incremental holding device may hold the crank, and the crankbar secured thereto, at varying positions so that the cover means may be held at varying distances above the container means.

The invention will be more fully understood from the following detailed description and appended claims when taken with the drawings in which:

Figure 1:
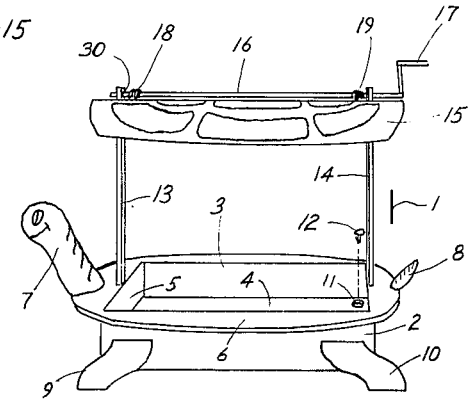
FIG. 1 is a perspective view from one side of the combination animal toy and container 1 with the cover 15 in a raised position.

Referring now to the drawings, FIG. 1 is a perspective view from the left side of the combination animal toy and container 1. Container means such as the container shown with container sides 2 and 3, container bottom 4, and container front 5, are placed within the combination animal toy and container 1.

A rim 6 surrounds the container means and is attached to the container sides 2 and 3, the container front 5, and the container back. The rim 6 is of sufficient width so that a child or children may sit on the rim 6 and play within the container means.

The container bottom 4 has hole 11 through which any materials held within the container means may be removed. Drain plug 12 and hole 11 comprise drain means in the bottom of the container means.

Appendage means such as turtle head 7 and turtle tail 8 extend from the combination animal toy and container 1 and simulate a plurality of appendages of the animal. The appendage means may further comprise a plurality of bottom supports, such as front leg 9 and rear leg 10, which simulate a plurality of feet of an animal, i.e., the turtle legs. In the specific example shown in FIG. 1, two other bottom supports simulating turtle feet are located on the combination animal toy and container, but are not shown.

The combination animal toy and container 1 also comprises cover means operative to cover the container means and shaped to simulate the outer portion of an animal. The cover means comprises cover 15. Elevating means are connected to the container means, and the cover means, and is operative to raise or lower the cover means over the container means.

Front vertical support 13 is rigidly secured to the front portion of rim 6. Rear vertical support 14 is rigidly secured to the back portion of rim 6. Crankbar 16 extends through the upper portion of the plurality of vertical supports 13 and 14, and is revolved by crank 17 to wrap or unwrap a plurality of line or rope, such as front line 18 and rear line 19, around crankbar 16; and therefore, to raise or lower cover 15.

Figure 2:
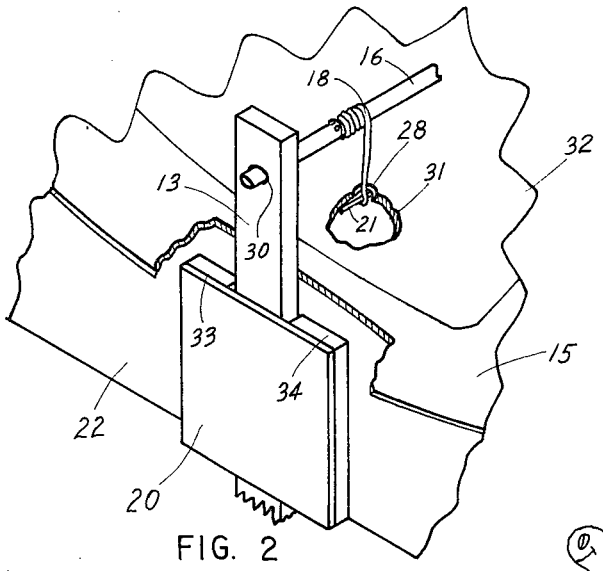
FIG. 2 is an enlarged cut-away view of the front of cover 15.

FIG. 2 shows an enlarged cut-away view of the front of cover 15. Cover 15 is secured to a front plate 22 and a similar rear plate not shown. Each of the plurality of vertical supports 13 and 14 extends through one of a plurality of cover means support guides. Front vertical support 13 extends through front cover means support guide 20. Rear vertical support 14 extends through a rear cover means support guide which is not shown.

A cut-away area 31 is shown in cover 15 in order to show lift pin 21, which is pressed against cover 15 and is secured to front line 18, which extends through front line hole 28 in cover 15.

Front cover means support guide 20 has support sections 33 and 34, which guide and support front vertical support 13.

Animal markings such as turtle markings 32 may be used to help simulate the desired animal.

Figure 3:
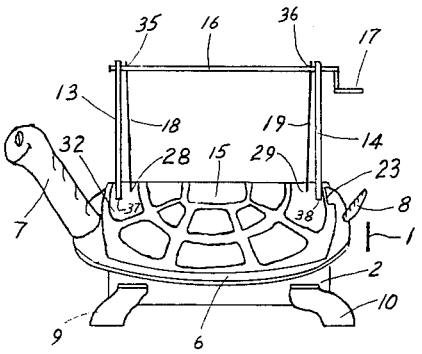
FIG. 3 is a perspective view from one side of the combination animal toy and container 1 with the cover 15 in a lowered position.

FIG. 3 is a perspective view from one side of the combination animal toy and container 1 with the cover 15 in a lowered position. Cover 15 has cut-away portion 23 which allows room for the crank 17 to turn when the combination animal toy and container is near the raised position. Cover 15 has front line hole 28 to allow line 18 to extend through cover 15. Cover 15 has rear line hole 29 in order to allow rear line 19 to extend through cover 15. Front line 18 is secured to lift pin 21. Rear line 19 is secured to a lift pin not shown.

Crankbar 16 may have a front hole 35 through which front line 18 may be attached. Crankbar 16 may have a rear hole 36 through which rear line 19 may be attached.

Cover 15 has a front hole 37 through which front vertical support 13 may pass. Cover 15 may have a rear hole 38 through which rear vertical support 14 may pass.

Front vertical support 13 has an opening 30 through which crankbar 16 may extend. Rear vertical support 14 has an opening not shown through which crankbar 16 may extend.

Figure 4:
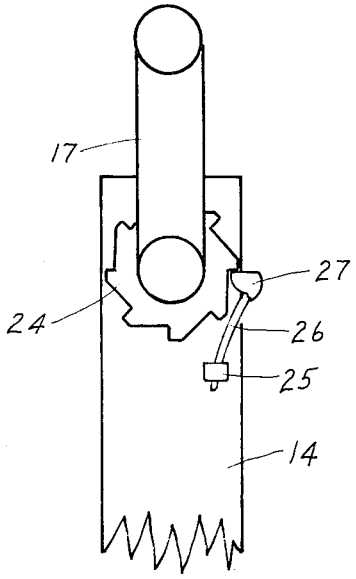
FIG. 4 is an enlarged view of crank 17 and the incremental holding device.

FIG. 4 is an enlarged view of crank 17 and the incremental holding device. The crank 17 is secured to crankbar 16 and turns circularily. The incremental holding device is operative to hold crank 17 and crankbar 16 secured thereto at varying positions so that the cover 15 may be held at varying distances above the container means. The incremental holding device comprises an incremental gear 24 secured to crank 17, and a stopping device comprising incremental stop 27, spring 26, and rigid pin 25. As the crank 17 is turned, gears on incremental gear 24 are shaped so that incremental stop 27 may secure the incremental gear 24 at various gear positions.

Another method of maintaining the cover 15 at various distances above the container means would be to place a plurality of holes in each vertical support and placing a peg through each support with the peg holding the cover 15 in position. A peg could be placed through the end of crankbar 16 in order to prevent the crankbar 16 from coming through opening 30 in front vertical support 13.

The present invention may be constructed of any material, including plywood or wood construction, and may have molded pieces made from molded plastic, fiberglass, or any other material. The animal appendages may be molded and made from any material.

This invention applies to the simulating of any animal. The example shown is a turtle, with the simulated head of a turtle, the bottom supports simulate turtle feet, the cover means a simulated turtle shell, and a simulated turtle tail.

The combination animal toy and container may be used as a sandbox, swimming pool, or simply a play area. Desired material may be contained within. The material may be kept dry by use of the cover. Any method may be used for holding the cover means above the container means. Any size container means may be used. The raising and lowering of the cover can be accomplished with ease by even the smallest housewife without any assistance. Children of all ages will be able to use the present invention an an animal toy, a sandbox, a swimming pool, or a play area.

While this invention has been described with reference to specific embodiments, the description is illustrative and is not to be construed as limiting the scope of this invention. Various modifications and changes may occur to those skilled in the art without departing from the spirit and scope of the invention as defined by the appended claims.

I claim:

1. A combination animal toy and container comprising:

a. a container means operative to hold materials and shaped whereby a child may enter said container means;

b. cover means operative to cover said container means and convexly contoured to simulate the outer portion of an animal;

c. appendage means extending from said combination animal toy and container, simulating a plurality of appendages of an animal wherein said appendage means comprises a plurality of feet-simulating, load-bearing bottom supports, which support said combination animal toy and container, and which simulate a plurality of feet of an animal;

d. elevating means, connecting to said container means and through said cover means, operative to raise or lower said cover means over said container means;

e. an oval-shaped rim surrounding said container means of sufficient width whereby a child may sit on said rim; and f. said elevating means comprising a plurality of rectangular, vertical supports connected to said container means and extending through said cover means; a crankbar extending through the upper portion of said plurality of rectangular, vertical supports containing a plurality of holes within said crankbar; a crank connected to said crankbar; a plurality of line secured to said cover means, each of said plurality of line extending through one of said plurality of holes within said crankbar whereby when said crank is turned, said crankbar revolves to wrap or unwrap said plurality of line around said crankbar and, therefore, raise or lower said cover means.

2. A combination animal toy and container according to claim 1 further comprising a plurality of rectangular cover means support guides, contained within said cover means, whereby each of said plurality of rectangular vertical supports extends through one of said plurality of rectangular cover means support guides.

3. A combination animal toy and container according to claim 2 further comprising an incremental holding device operative to hold said crank, and said crankbar secured thereto, at varying positions whereby said cover means may be held at varying distances above said container means.

4. A combination animal toy and container according to claim 3 further comprising a cut-away portion in said cover means operative to allow full movement of said crank when said cover means is raised.

* * * * *